US006361356B1

(12) United States Patent
Heberlein et al.

(10) Patent No.: US 6,361,356 B1
(45) Date of Patent: Mar. 26, 2002

(54) ELECTRICAL CONNECTOR POSITION ASSURANCE DEVICE

(75) Inventors: Dennis E Heberlein, Warren; Adam M. Kemp, Youngstown, both of OH (US)

(73) Assignee: Delphi Technologies, Inc., Troy, MI (US)

( * ) Notice: Subject to any disclaimer, the term of this patent is extended or adjusted under 35 U.S.C. 154(b) by 0 days.

(21) Appl. No.: 09/678,464

(22) Filed: Oct. 3, 2000

(51) Int. Cl.[7] ..... H01R 3/00
(52) U.S. Cl. ..... 439/489; 439/347; 439/157
(58) Field of Search ..... 439/489, 157, 439/188, 488, 490, 347

(56) References Cited

U.S. PATENT DOCUMENTS 5,135,410 A * 8/1992 Kawase et al. ..... 439/489
5,470,251 A * 11/1995 Sano ..... 439/489
5,494,450 A * 2/1996 Kirsch et al. ..... 439/188
5,600,300 A * 2/1997 Povilaitis ..... 439/489
5,647,754 A * 7/1997 Kohno ..... 439/489

* cited by examiner

*Primary Examiner*—Tho D. Ta
*Assistant Examiner*—Briggitte R. Hammond
(74) *Attorney, Agent, or Firm*—Thomas N. Twomey

(57) ABSTRACT

An electrical connection position assurance system that includes a pair of electrically connected contacts (46) affixed on a pivotably mounted arm (16). When the arm (16) is moved to its engage position, the contacts protrude through respective openings (52) in a harness wire dress cover (12) to close a pilot circuit (56) that has terminals (54) mounted below openings (52). The pilot circuit (56) is operably connected to a computer circuit (66) which controls illumination of an indicator light (68) depending upon whether pilot circuit (56) is closed by contacts (46).

14 Claims, 7 Drawing Sheets

ELECTRICAL CONNECTOR POSITION ASSURANCE DEVICE

TECHNICAL FIELD

The field of this invention relates to automotive electrical boxes and harness connectors having electrical connector position assurance mechanisms.

BACKGROUND OF THE INVENTION

Electrical systems in automobiles have become modular in recent years. The wires from various components become harnessed together into a harness connector that is plugged into a header of an electrical box. These electrical components range from optional accessories such as auxiliary power outlets to important microprocessors that control air bag actuation or control the combustion process of the engine. It is thus important to assure that the harness connector is properly connected to the header such that all the electrical circuits are connected.

Mechanical devices are known which provide a mechanical advantage to expedite connection of the multiple electrical sockets into the header. Furthermore, these mechanical devices are commonly in the form of a latch. A second separate movable member provides a visual indication that the harness is properly mounted. The visual indicator member can not be mounted or connected if the operating latch is not fully closed.

Attempts have been made to use an electrical indicator to assure that the harness connector is properly connected to the header. These systems' objective is to have an electrical indicator alarm such as a conveniently positioned light operably connected to the connector. These previous attempts provide for a separate connector being plugged into the connection system. The addition of a second movable member undesirably adds size and complexity to the electrical connection harness system. The extra size is particularly undesirable when the harness system is mounted under an interior instrument panel where space is extremely limited.

What is needed is an electrical position assurance system that adds no separate movable components to the harness connector and adds no size to the present mechanical harness connector and still further allows visual confirmation of a properly mated connection between the harness connector and the header.

SUMMARY OF THE INVENTION

In accordance with one aspect of the invention, a harness connector for an electrical connection box includes a connector housing having an open end having a plurality of pin connections constructed to be releasably installed onto complementary pin connections of a header section of the electrical connection box. A latching device is movable between an engage position and a release position with the header for selectively retaining the connector housing to the header section. An arm lever is operably connected to the latching device. The arm lever correspondingly and pivotably moves between its release and engage positions. The connector housing has two electrical contacts forming a pilot circuit that is operably connected to an indicator circuit.

The arm lever is constructed to electrically connect the two electrical contacts when the arm lever is moved to its lock position to close the pilot circuit and control the indicator circuit. The indicator circuit correspondingly indicates that the arm lever has fully locked the connector housing in its installed position on the header. Commonly, the indicator circuit illuminates an appropriate warning light when the arm is not in the engage position.

The arm lever in one embodiment has a pair of leg sections pivotably mounted onto the connector housing and a bight section extending between the two legs.

The indicator circuit includes wiring in the connector housing that includes a plurality of pin connections between the connector housing and the header. In one embodiment, the indicator circuit includes a microprocessor that activates an instrument panel indicator when the arm lever is not in its engage position. The indicator circuit includes a visual indicator that indicates when the arm lever is not in its engage position.

The arm lever preferably has at least one leg section pivotably mounted to the connector housing and a transverse section at a distal end of at least one leg section. The transverse section has an electrically conductive strip extending a substantial length of the transverse section.

The conductive strip contacts both electrical contacts when the arm lever is in the locked position. Preferably this closes a pilot circuit which controls the indicator circuit. The conductive strip preferably has prongs that extend through openings in a top surface of the connector housing when the arm lever is in its engage position. The contacts are desirably recessed below the top surface of the connector housing and aligned with openings to contact the prongs when the prongs extend through the openings.

The connector housing preferably has a resilient lock button that resiliently flexes to allow the arm lever move to the engage position and locks the arm lever in place until the lock button is manually operated and moved to release the arm lever from the engage position.

In accordance with another aspect of the invention, an electrical box and harness connector assembly includes a connector housing having an open end. The open end has a plurality of pin connections. A header section of the electrical box has complementary pin connections that connect to the pin connections of the connector housing. The latching device is mounted on one of the connector housing and electrical box and movable between an engage position and a release position for selectively retaining the connector housing to the header. The arm lever is pivotably mounted onto one of the electrical box and connector housing and movable between a releasing and a lock position and operably connected to the latching device for moving the latching device between its engage and release positions.

BRIEF DESCRIPTION OF THE DRAWINGS

Reference now is made to the accompanying drawings in which.

DESCRIPTION OF THE PREFERRED EMBODIMENT

Figure 1:
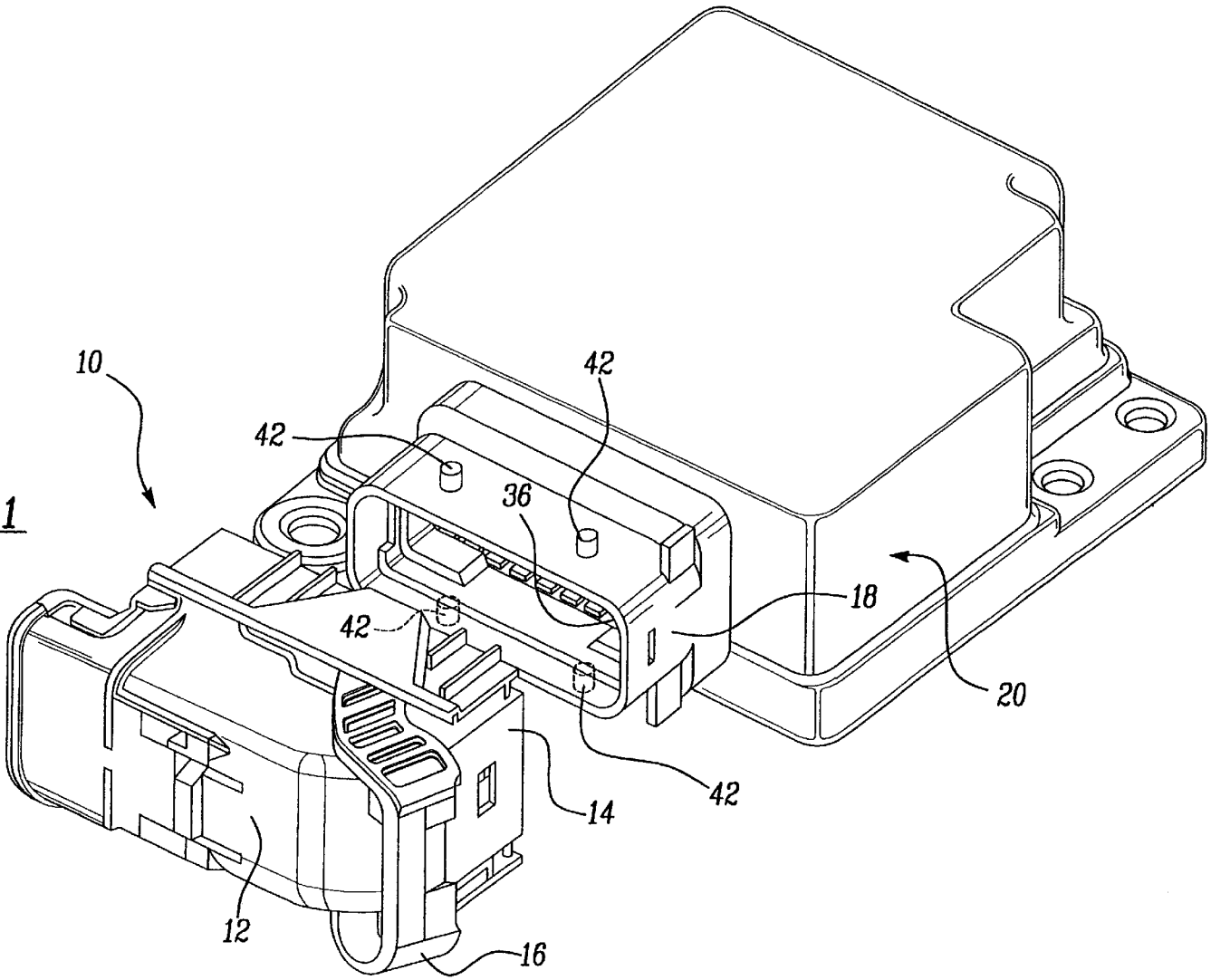
FIG. 1 is a perspective view of one embodiment of a harness connector in a release position adjacent to an electrical box.

Referring now to FIG. 1, a harness connector 10 includes a wire dress cover member 12, connected to a harness housing member 14. The harness housing member 14 pivotably mounts an arm lever 16 which operates between a release position and engage position to mount the harness connector 10 to a header section 18 of an electrical connection box commonly referred to as a software module 20.

Figure 2:
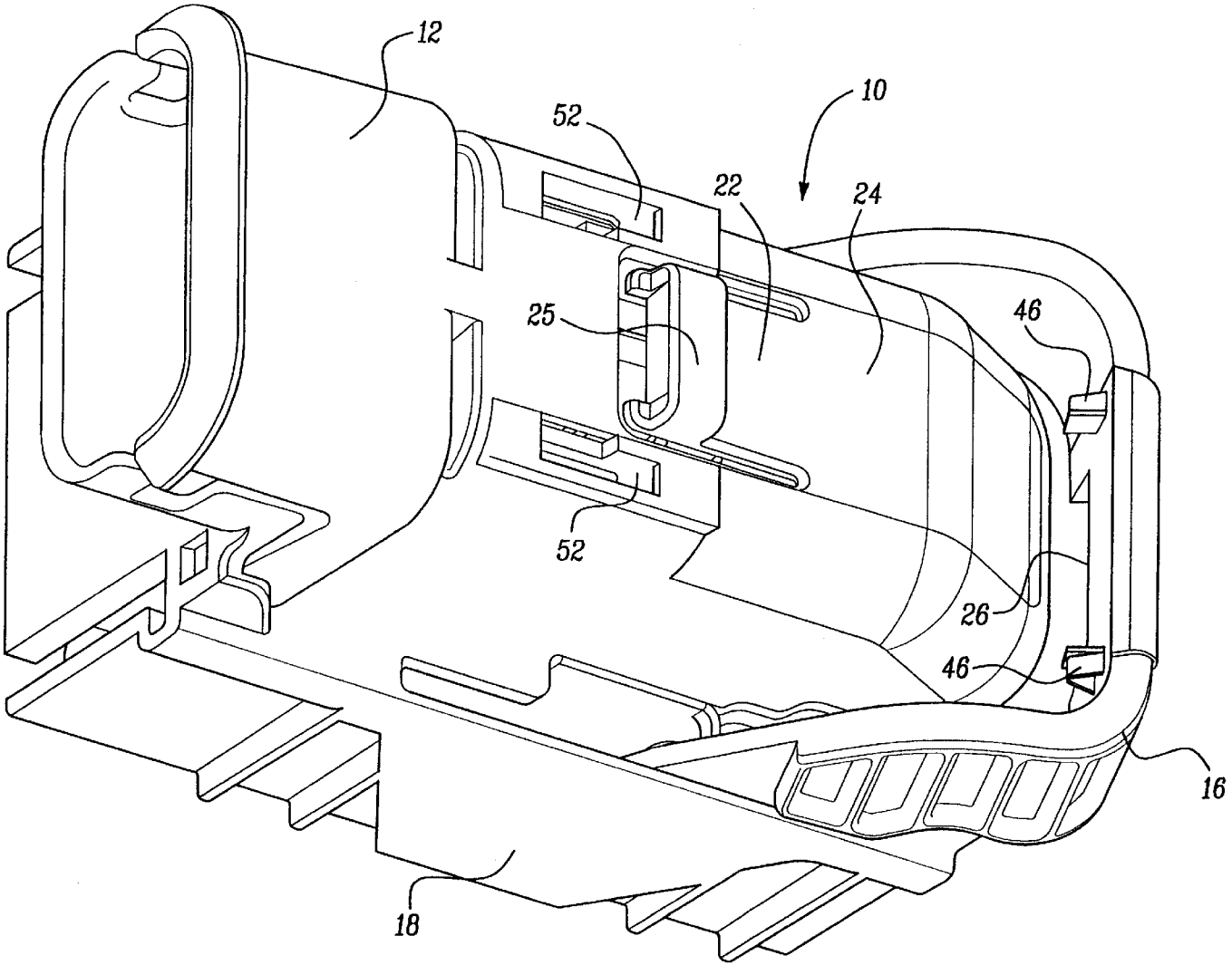
FIG. 2 is an enlarged perspective view of the harness connector shown in FIG. 1.
Figure 3:
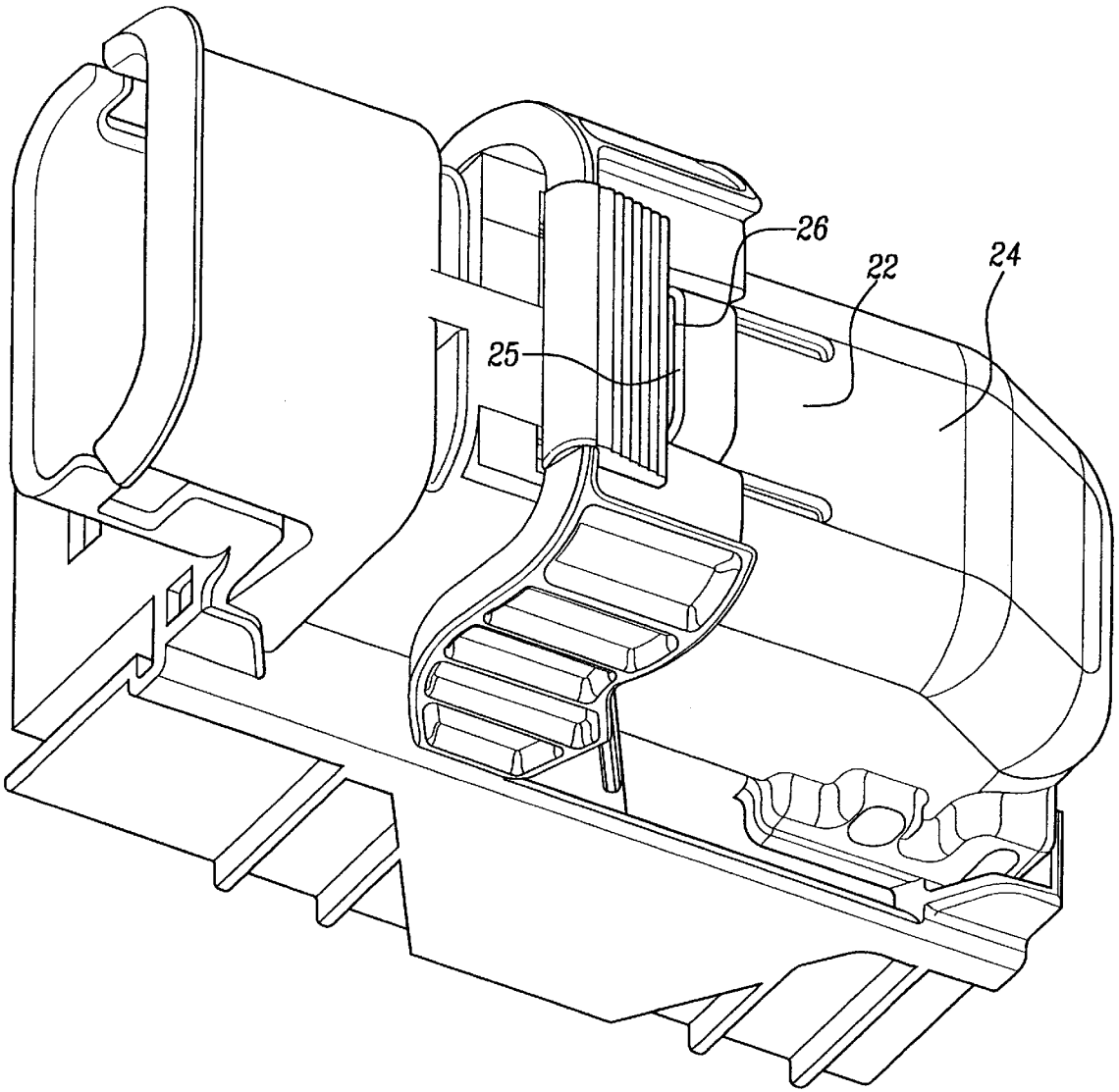
FIG. 3 is view similar to FIG. 2 showing the arm latch in the engage position.

As shown more clearly in FIGS. 2 and 3, the wire dress cover 12 is securely mounted to the harness housing 14. The arm lever 16 is pivotably movable between a release position as shown in FIG. 2 to an engage position shown in FIG. 3. The wire dress cover 12 is made from a plastic material. It has a tongue 22 formed in its upper wall 24 that flexes to allow a snap lock engagement of the arm lever 16 to its engage position. The raised end 25 of tongue 22 engages rear notch edge 26 of the arm 16 to form a releasable lock for the arm lever 16. As shown in FIG. 3, once the arm lever 16 is snapped into its engage position, the raised end 25 releasably locks the arm in its engage position until the tongue 22 is manually flexed downwardly to disengage from the arm lever 16. This disengagement allows the arm lever to be moved back to its release position as shown in FIG. 2.

Figure 4:
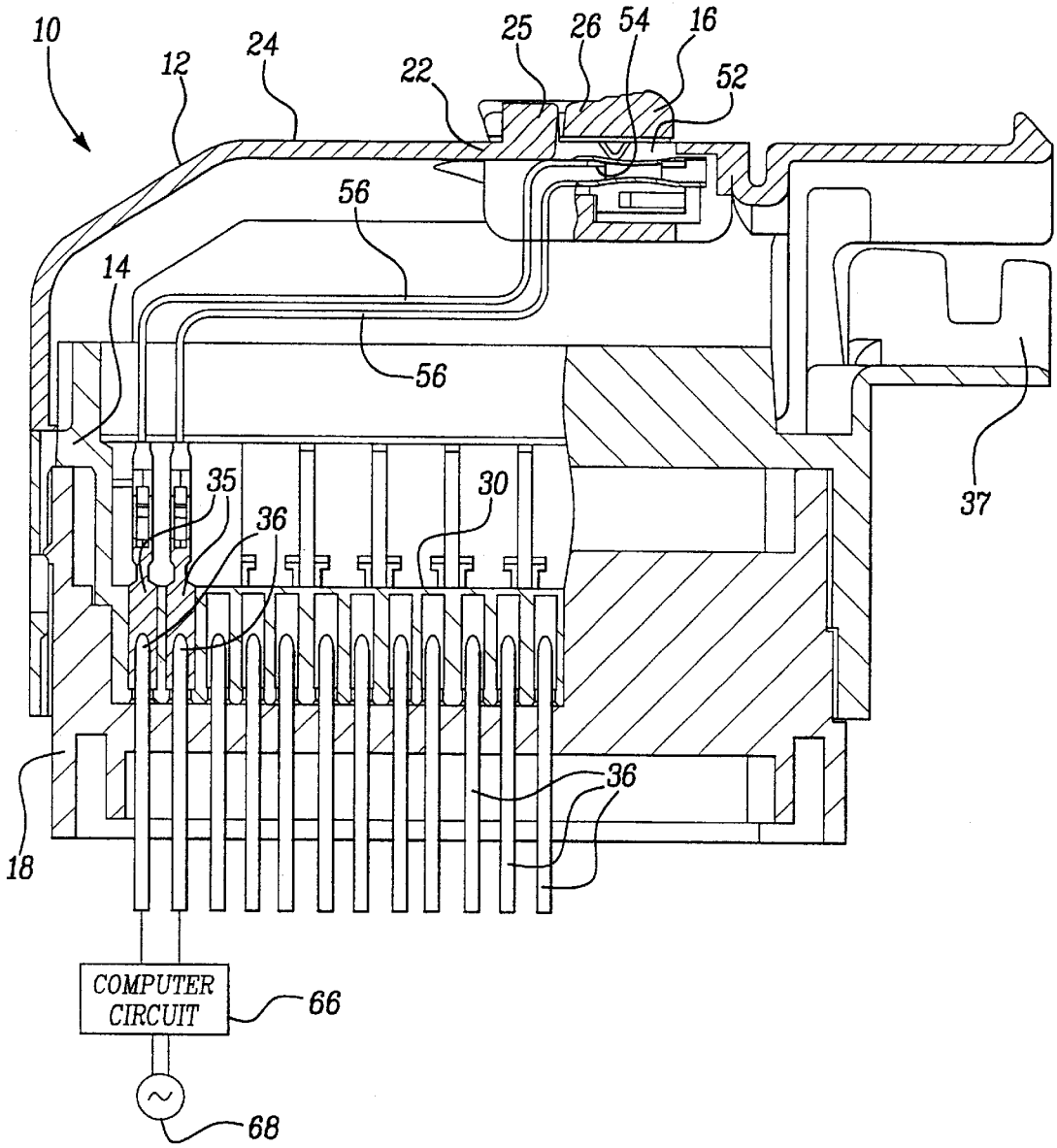
FIG. 4 is a segmented view illustrating the connector housing engaged and locked onto the electrical box header.
Figure 5:
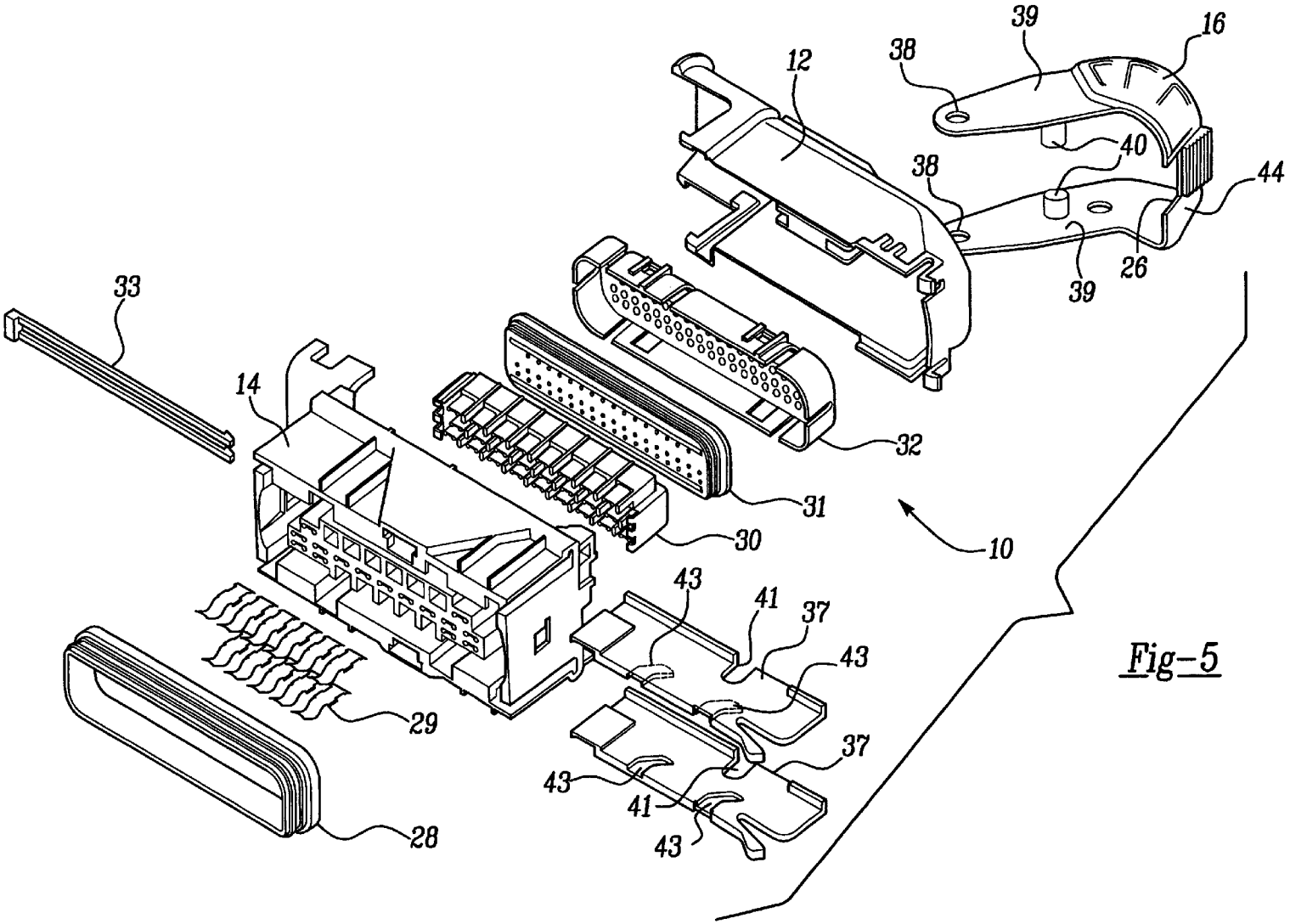
FIG. 5 is an exploded perspective view of the harness connector shown in FIG. 1.
Figure 6:
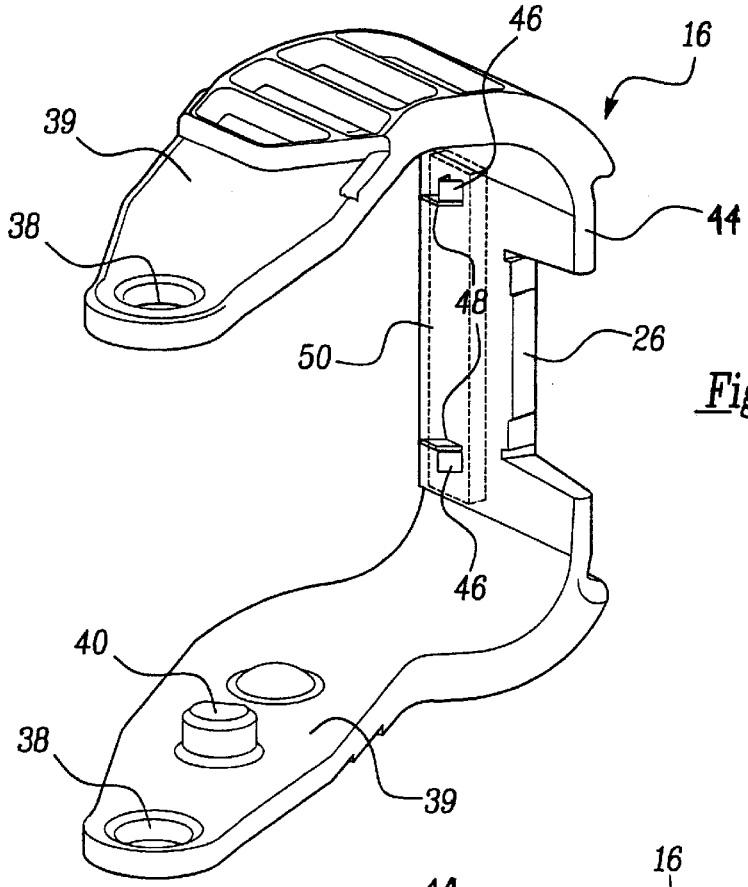
FIG. 6 is perspective bottom view of the arm latch shown in FIG. 1.
Figure 7:
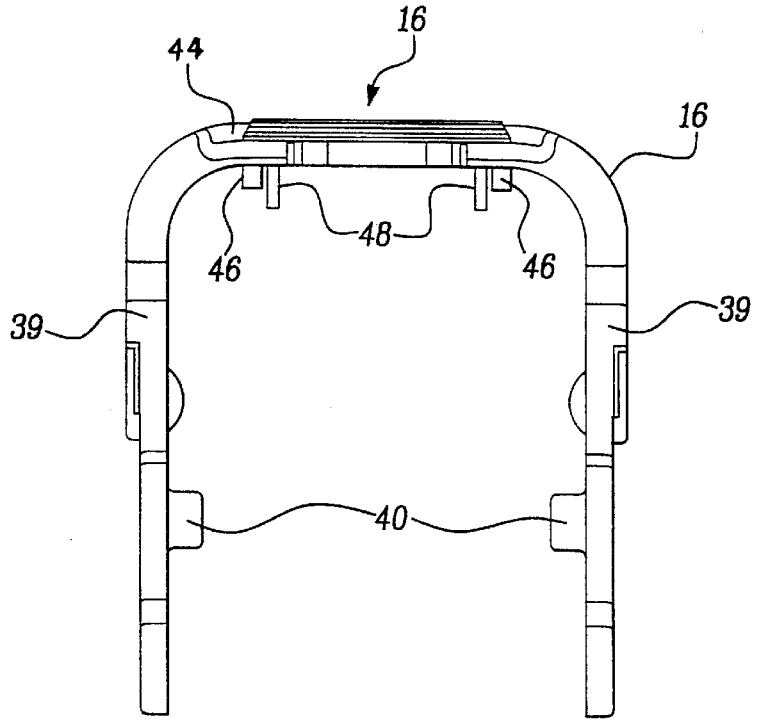
FIG. 7 is a side elevational view of the arm latch shown in FIG. 6.
Figure 8:
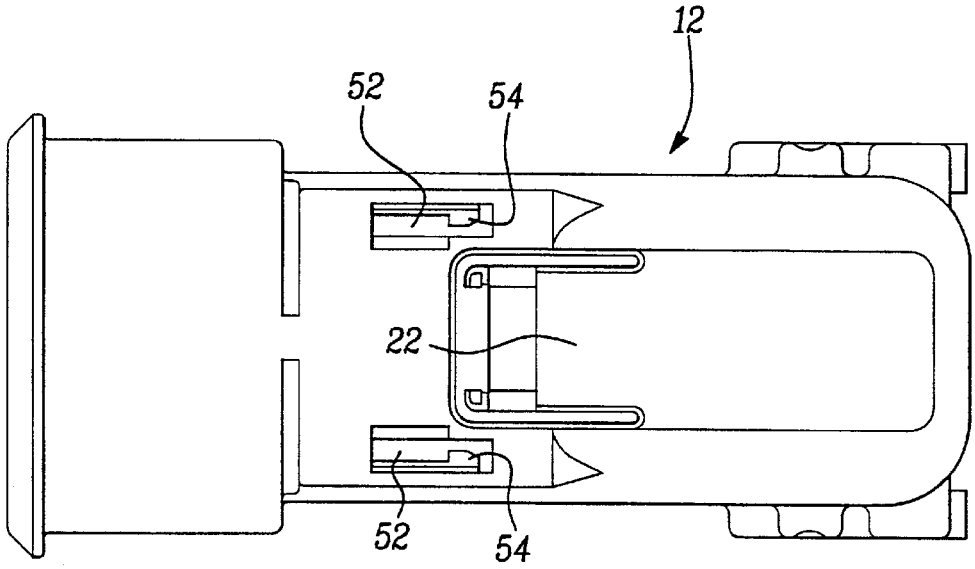
FIG. 8 is a top plan view of the connector housing cover shown in FIG. 1.
Figure 9:
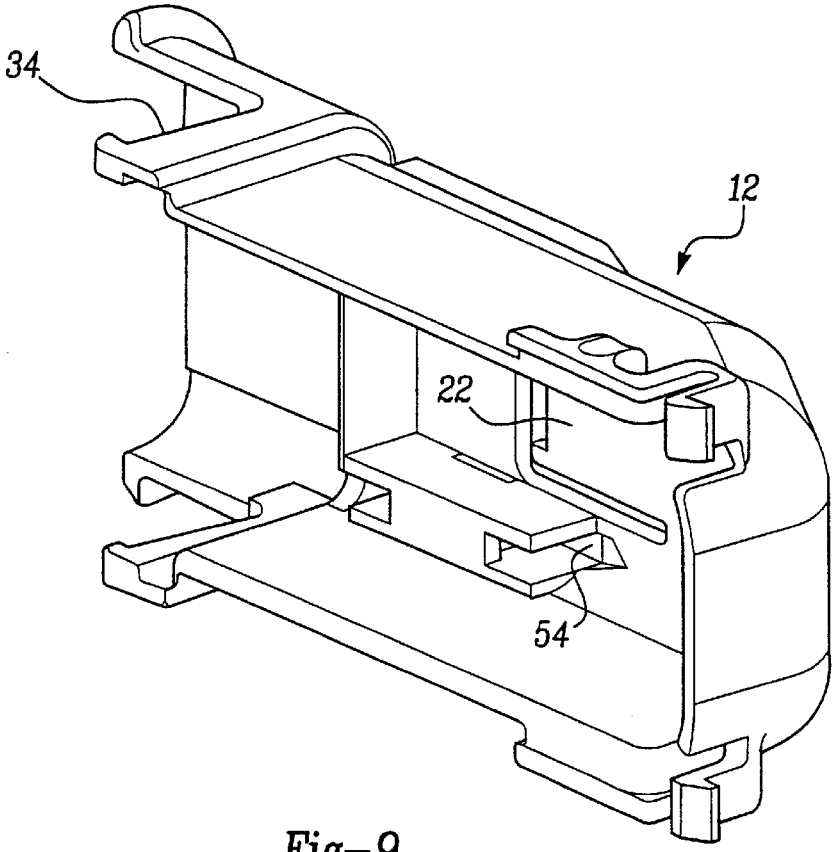
FIG. 9 is a bottom perspective view of the cover shown in FIG. 8.

Referring now to FIGS. 4 and 5, the harness connector housing 14 houses various standard wire terminal retaining components, namely a connector seal 28, inner connector 30, cable seal 31, strain relief member 32 and secondary lock 33. Short clips 29 are mounted in housing member 14. Electrical wire (not shown for simplicity of the drawing) extends through opening 34 formed between housing 14 and dress cover 12. The wire passes through member 32 and 31. The wires are connected to female terminals 35 and the terminals 35 are placed in inner connector 30. These female terminals 35 engage complementary formed pins 36 formed in the header 18.

Because of the plurality of female terminals 35 and pins 36 which must be press fitted together, the connection between the harness connector 10 and header 18 is not easily pressed together by hand. The arm lever 16 provides a mechanical advantage through the use of slide latching devices or levers 37. The arm lever 16 is pivotably mounted to housing 14 through its two pivotal openings 38 in side arms 39. Opposing protuberances 40 engage respective slots 41 at the top of slide latching levers 37. When the housing 14 is placed onto header 18, the two pairs of engaging pins 42 on header 18 are seated in respective curved recessed channels 43 in slide levers 37. As arm lever 16 is pivoted to the engage position, it slides the latching device 37 within and with respect to the housing member 14 and such that pins 42 slide within the recessed channels 43. Coincidedly, the housing 14 is pressed onto header 18 onto the pins 36 to engage the wire terminal 35 thereon. The tongue 22 then locks the arm 16 in the engage position.

In addition to the visible position of the arm in its engage position, the arm lever 16 carries two electrical contacts 46 in the form of downwardly extending prongs on its distal bight section 44 which connects the two side arms 39 together. The prongs 46 are adjacent two depending protective flanges 48. The contacts 46 are electrically connected together via a strip section 50. The contacts 46 and strip 50 may be integrally formed as a single unitary piece of metallic material and also be coated with gold plating to preserve its electrical connectivity even in harsh environments. The contacts 46 and strip 50 are affixed to the bight section 44. The affixation can be by adhesives, welding, clips, bands, or by a snap fit. The method is not important so long as the affixation is secure and durable.

When the arm 16 is in the engage position, as shown in FIG. 4, the contacts 46 protrude through respective openings 52 in the upper wall 24 of the wire dress cover 12. Electrical terminals 54 of a pilot circuit 56 are mounted below the openings to be closed by the contacts 46 and strip 50. The pilot circuit 56 includes two female wire terminals 35 and two male pins 36. The pilot circuit 56 is operably connected to the computer circuit 66 in software module 20 which in turn operably controls an indicator light 68 which may be mounted in the automobile instrument panel. The light 68 is controlled by the computer circuit 66 such that it is illuminated when the circuit 56 is open, i.e. the contacts 46 do not close the circuit 56. When the arm 16 is fully in the engaged position, the contacts close pilot circuit 56 which in turn tells the computer circuit 66 to turn off the light 68. Alternately, the pilot circuit 56 may be directly connected to the indicator light 68. In this alternate, the light is illuminated when the arm 16 is fully engaged and is not illuminated when the arm is not fully engaged.

As such, arm 16 provides for a mechanical visual indication when the harness connector 10 is fully seated and locked onto header 18 as well as an electrical indication system via indicator light 68 which provides visual warning when the harness connector is not fully mated with the header 18. The secondary electrical contacts 46 and circuits 56 and 66 are installed without increasing the size of the harness connector 10. The electrical connection position assurance system is incorporated into an existing mechanical assist locking arm 16 without the addition of a second connector or an increase in size of the harness connector. The electrical connection position assurance system provides a reliable warning for the header being not fully mated with the harness connector. In addition, the gold plating and the closed nature of the contacts 46 when the arm 16 covers openings 52 provides for a durable system that is reliable for the life of the automobile.

Variations and modifications are possible without departing from the scope and spirit of the present invention as defined by the appended claims.

What is claimed is:

1. A harness connector for an electrical connection box having a header; said harness connector characterized by:

a connector housing having an open end having a plurality of pin connections constructed to be releasably installed onto complementary pin connections of the header;

a latching device constructed and arranged to slide linearly within the connector housing between an engaged position and a release position with the header for selectively retaining said connector housing to said header, the latching device having a curved recessed channel;

an arm lever pivotably mounted onto said connector housing between a releasing and a lock position and operably connected to said latching device for moving the latching device between the engage and release positions, the curve of the recessed channel correlating with the pivotal direction of the arm lever;

the header having a pin disposed within the recessed channel of the latching device; and said arm lever having two electrical contacts operably connected to an indicator circuit, wherein said arm lever is constructed to electrically connect said two electrical contacts when said arm lever is moved to its lock position to control the indicator circuit that indicates said arm lever has fully locked said connector housing in its installed position on said header.

2. The harness connector as defined in claim 1 further characterized by:

said arm lever having at least one leg section pivotably mounted onto the connector housing and a transverse section at a distal end of the at least one leg section;

said transverse section having a electrically conductive strip extending a substantial length of the transverse section; and said conductive strip contacting both of said electrical contacts when said arm lever is in the locked position to control the indicator circuit.

3. The harness connector as defined in claim 2 further characterized by:

said arm lever having a pair of leg sections pivotably mounted onto the connector housing; and said transverse section being a bight section extending between said two legs.

4. A harness connector for an electrical connection box having a header; said harness connector characterized by:

a connector housing having an open end having a plurality of pin connections constructed to be releasably installed onto complementary pin connections of the header;

a latching device movable between an engaged position and a release position with the header for selectively retaining said connector housing to said header;

an arm lever pivotably mounted onto said connector housing between a releasing and a lock position and operably connected to said latching device for moving the latching device between its engage and release positions;

said connector housing having two electrical contacts operably connected to an indicator circuit;

said arm lever constructed to electrically connect said two electrical contacts when said arm lever is moved to its lock position to control the indicator circuit that indicates said arm lever has fully locked said connector housing in its installed position on said header;

said arm lever having at least one leg section pivotably mounted onto the connector housing and a transverse section at a distal end of the at least one leg section;

said transverse section having a electrically conductive strip extending a substantial length of the transverse section;

said conductive strip contacting both of said electrical contacts when said arm lever is in the locked position to control the indicator circuit;

said conductive strip having prongs that extend through openings in a top surface of said connector housing when said arm lever is in its engaged position; and said contacts being recessed below said top surface of said connector housing and aligned with said openings therethrough to contact said prongs when said prongs extend through said openings.

5. The harness connector as defined in claim 4 further characterized by:

said indicator circuit includes wiring in said connector housing that includes a plurality of pin connections between said connector housing and said header.

6. The harness connector as defined in claim 5 further characterized by:

said indicator circuit includes a pilot circuit and a computer circuit that activates a instrument panel indicator when the arm lever is not in its engage position.

7. The harness connector as defined in claim 4 further characterized by:

said connector housing having a resilient lock button that biases to let said arm lever move to the engage position and locks said arm lever in place until it is manually operated and moved to release said arm lever from the engage position.

8. The harness connector as defined in claim 5 further characterized by:

said indicator circuit includes a visual indicator that indicates the status that the arm lever is not in its engage position.

9. The harness connector as defined in claim 8 further characterized by:

said arm lever having a pair of leg sections pivotably mounted onto the connector housing; and said transverse section being a bight section extending between said two legs.

10. An electrical box and harness connector assembly characterized by:

a connector housing having an open end having a plurality of pin connections;

a header section of the electrical box having complementary pin connections that connect to the pin connections of the connector housing;

a latching device mounted on one of the connector housing and electrical box and movable between an engage position and a release position for selectively retaining said connector housing to said header, the latching device being moveable with respect to the header section;

an arm lever pivotably mounted onto one of said electrical box and connector housing and movable between a releasing and a lock position and operably connected to said latching device for moving the latching device between its engage and release positions, the arm lever being moveable with respect to the latching device; and said arm lever having two electrical contacts operably connected to an indicator circuit, wherein said arm lever is constructed to electrically connect said two electrical contacts when said arm lever is moved to its lock position to activate the indicator circuit that indicates said arm lever has fully locked said connector housing in its installed position on said header.

11. The electrical box and harness connector assembly as defined in claim 10 further characterized by:

said arm lever having at least one leg section leg section pivotably mounted onto one of the electrical box and connector housing and a transverse section at a distal end of the at least one leg section;

said transverse section having a electrically conductive strip extending a substantial length of the transverse section; and said conductive strip contacting both of said electrical contacts when said arm lever is in the locked position to activate the indicator circuit.

12. An electrical box and harness connector assembly characterized by:

a connector housing having an open end having a plurality of pin connections;

a header section of the electrical box having complementary pin connections that connect to the pin connections of the connector housing;

a latching device mounted on one of the connector housing and electrical box and movable between an engage position and a release position for selectively retaining said connector housing to said header;

an arm lever pivotably mounted onto one of said electrical box and connector housing and movable between a releasing and a lock position and operably connected to said latching device for moving the latching device between its engage and release positions;

said connector housing having two electrical contacts operably connected to an indicator circuit;

said arm lever constructed to electrically connect said two electrical contacts when said arm lever is moved to its lock position to activate the indicator circuit that indicates said arm lever has fully locked said connector housing in its installed position on said header;

said arm lever having at least one leg section leg section pivotably mounted onto one of the electrical box and connector housing and a transverse section at a distal end of the at least one leg section;

said transverse section having a electrically conductive strip extending a substantial length of the transverse section;

said conductive strip contacting both of said electrical contacts when said arm lever is in the locked position to activate the indicator circuit;

said conductive strip having prongs that extend through openings in a top surface of said connector housing when said arm lever is in its engaged position; and said contacts being recessed below said top surface of said connector housing and aligned with said openings therethrough to contact said prongs when said prongs extend through said openings.

13. The electrical box and harness connector assembly as defined in claim 12 further characterized by:

said arm lever having a pair of leg sections pivotably mounted onto the connector housing; and said transverse section being a bight section extending between said two legs.

14. The electrical box and harness connector assembly as defined in claim 13 further characterized by:

said connector housing having a resilient lock button that biases to let said arm lever move to the engage position and locks said arm lever in place until it is manually operated and moved to release said arm lever from the engage position.

* * * * *